US007009176B2

(12) United States Patent
Thakur

(10) Patent No.: US 7,009,176 B2
(45) Date of Patent: Mar. 7, 2006

(54) TITANIUM ION TRANSFER COMPONENTS FOR USE IN MASS SPECTROMETRY

(75) Inventor: Rohan Thakur, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 10/796,717

(22) Filed: Mar. 8, 2004

(65) Prior Publication Data

US 2005/0194530 A1 Sep. 8, 2005

(51) Int. Cl.
*H01J 49/06* (2006.01)

(52) U.S. Cl. ..... 250/288; 250/287; 250/290

(58) Field of Classification Search ..... 250/288, 250/287, 290

See application file for complete search history.

(56) References Cited

U.S. PATENT DOCUMENTS

| | | | | |
|---|---|---|---|---|
| 4,814,612 | A * | 3/1989 | Vestal et al. | 250/288 |
| 5,157,260 | A | 10/1992 | Mylchreest et al. | |
| 5,171,990 | A | 12/1992 | Mylchreest et al. | |
| 5,432,343 | A | 7/1995 | Gulcicek et al. | |
| 5,596,193 | A * | 1/1997 | Chutjian et al. | 250/292 |
| 5,750,993 | A | 5/1998 | Bier | |
| 5,793,039 | A * | 8/1998 | Oishi et al. | 250/288 |
| 6,049,052 | A * | 4/2000 | Chutjian et al. | 219/69.12 |
| 6,060,705 | A | 5/2000 | Whitehouse et al. | |
| 6,392,225 | B1 | 5/2002 | Schwartz et al. | |
| 6,555,814 | B1 * | 4/2003 | Baykut et al. | 250/288 |
| 6,580,067 | B1 * | 6/2003 | Yamada et al. | 250/281 |
| 6,703,610 | B1 * | 3/2004 | Mordehai | 250/288 |
| 6,797,948 | B1 * | 9/2004 | Wang | 250/292 |
| 6,872,940 | B1 * | 3/2005 | Thakur | 250/288 |
| 2003/0146378 | A1 | 8/2003 | Mordehai | |

FOREIGN PATENT DOCUMENTS

JP 411025903 * 1/1999

OTHER PUBLICATIONS

Titanium General Information Characteristics of the Alloys, http://www.titanium.org/GIsec2b.htm (2 pages).
Titanium Iformation, Manufacturing Techniques, http://www.titanium.org/GIsec2b.htm, (10 pages).
Titanium Information, Selection of Forms and Properties, http://www.titanium.org/GIsec2b.htm, (4 pages).
Titanium, http://pearll.lanl.gov/periodic/elements/22.html (3 pages).
Titanium, http://www.scescape.net/~woods/elements/titanium.html (4 pages).
NTD Resource Center, "Electrical Conductivity & Resistivity for Titanium and Titanium Alloys," http://www.ndt-ed.org/GeneralResources/MaterialProperties/ET/ET_matlprop_Titanium.htm (2 pages).
Kobelco, "Titanium Characteristics," http://www.kobelco.co.jp/titan/e/feature.htm (4 pages).

* cited by examiner

*Primary Examiner*—Nikita Wells
*Assistant Examiner*—Anthony Quash
(74) *Attorney, Agent, or Firm*—Sharon Upham; Fish & Richardson P.C.

(57) ABSTRACT

Systems and components for use in ion transfer in a mass spectrometer. The components include a body having an orifice through which ions can pass, wherein at least a portion of the body comprises titanium metal. Alternatively, the components can include an ion guide into which ions can pass, wherein at least a portion of the ion guide comprises titanium metal. The system has a source of ions for generating ions and a body having an orifice through which ions can pass, wherein at least a portion of the body comprises titanium metal.

14 Claims, 8 Drawing Sheets

TITANIUM ION TRANSFER COMPONENTS FOR USE IN MASS SPECTROMETRY

BACKGROUND

The present invention relates to ion transfer components for use in mass spectrometry.

A mass spectrometer analyzes mass-to-charge ratios of ions, and typically includes an ion source, ion optics, one or more mass analyzers, and one or more detectors. In the ion source, particles are ionized so that they can be influenced and manipulated via electrostatics. The ions may be transported through different vacuum stages using ion transfer optics, such as ion guides, to one or more mass analyzers, which separate the ions based on their mass-to-charge ratio. The separated ions are then detected by one or more detectors, which provide the data used to construct a mass spectrum of the sample.

Ion sources that operate at or near atmospheric pressure (Atmospheric Pressure Ionization or API sources) are useful for producing ions from non-volatile, higher molecular weight, molecules. The most prevalent use of API techniques in mass spectrometry (MS) is for ionization of molecules chromatographically separated using high pressure liquid chromatography techniques (LC-MS). The ability of API-MS techniques to handle a variety of LC flow rates with high analytical sensitivity, precision, and linearity, has made API-MS indispensable in the modern analytical laboratory.

There are two common types of API: atmospheric pressure chemical ionization (APCI) and electro-spray ionization (ESI). In APCI, a heated nebulizer is used to convert droplets of sample solution into the gaseous phase. A corona discharge electrode that is adjacent to the outlet of the nebulizer then ionizes the solvent and the sample molecules. In ESI, eluent containing the sample molecules of interest is passed through a small capillary. A strong potential, typically 1–5 KV, is maintained between the capillary and an adjacent surface such as the mass analyzer. As a result, the liquid disperses into fine ionized droplets when it emerges from the capillary. These droplets are heated, evaporating the solvent and making the droplets small and unstable, whereupon gaseous sample ions are formed.

Ions produced by API sources are typically transferred into a chamber that is at an intermediate pressure, e.g., lower than atmospheric pressure, and then directed into a chamber that is at low pressure, i.e., lower than the intermediate pressure chamber, via the use of ion optics. The ions enter the low-pressure chamber through an orifice, which is very small so that the low-pressure chamber can be maintained at low pressure. Ion transfer components such as electrostatic lenses with holes in them, multipole ion guides or skimmers are used to efficiently transfer ions from one region to another, typically across a pressure differential, for example from the intermediate pressure chamber to the low-pressure chamber.

Some ion transfer components, for example skimmers, reduce the undesirable effects of boundary conditions on the flow of ions and the resulting signal that is detected. For example, a conical shaped skimmer can reduce the effects of shock waves on the flow of ions. Other shapes and configurations are possible, but ion transfer components operating in the intermediate pressure regime typically have a sharp edge defining the orifice through which ions pass. Special configurations of systems that employ API and ion transfer components may further improve the quality of the resulting spectrum. For example, systems can be configured to use an off-axis alignment of the capillary tube and the skimmer, as described in U.S. Pat. No. 5,171,990, or to have various arrangements of trajectories, as described in U.S. Pat. No. 5,756,994.

Ion transfer components made of relatively inert, non-reactive materials such as stainless steel can reduce the accumulation of chemical deposits resulting from reaction of the ion transfer component with certain constituents of the gas. Such chemical deposits affect the surface flow dynamics of the ions and can compromise the performance of the skimmer. Ion transfer components can be made of glass, but they are subject to breakage when removed for cleaning or servicing. As described in U.S. Pat. No. 6,608,318 and U.S. Pat. Pub. 2003/0146378, inorganic conductive nitride compounds such as titanium nitride have been used to coat surfaces in the chamber and on the skimmer in order to reduce the accumulation of chemical deposits.

SUMMARY

The invention provides systems and components for use in mass spectrometry.

In general, in one aspect, the invention provides an ion transfer component in a mass spectrometer comprising a body having an orifice through which ions can pass, wherein at least a portion of the body comprises titanium metal.

Advantageous implementations can include one or more of the following features. The entire body can be titanium metal. At least a portion of the body can be coated with titanium metal. One or more surfaces of the ion transfer component can comprise titanium metal. The portion of the body comprising titanium metal can at least partially surround and define the orifice.

The titanium metal can be an alloy of titanium. The alloy of titanium can be an alloy of titanium and one or more of the metals in the group consisting of aluminum, vanadium, molybdenum, manganese, iron, platinum, tin, copper, niobium, zirconium, and chromium. The titanium metal can be commercially pure titanium, including commercial grade I, II, III, or IV titanium.

The ion transfer component can be a lens. The lens can be configured such that an electrostatic potential or an RF potential can be applied. The ion transfer component can be an RF only lens. The RF only lens can have a plurality of rods. A DC potential can be applied to the plurality of rods. The ion transfer component can be a skimmer.

In general, in another aspect, the invention provides an ion transfer component in a mass spectrometer comprising an ion guide into which ions can pass, wherein at least a portion of the ion guide comprises titanium metal.

Advantageous implementations can include one or more of the following features. The ion guide can have a plurality of rods. The ion transfer component can further include an enclosure, wherein at least part of the enclosure comprises titanium.

In general, in yet another aspect, the invention provides a system for analyzing ions. The system comprises a source of ions for generating ions and an ion transfer component including a body that has an orifice through which ions can pass, wherein at least a portion of the body comprises titanium metal.

Advantageous implementations can include one or more of the following features. The ions can adiabatically expand to form a supersonic free jet, and at least a portion of the ion transfer component can be disposed in an area of the free jet expansion. The ions can adiabatically expand to form a supersonic free jet, and at least a portion of the ion transfer component can be disposed in a zone of silence resulting from the free jet expansion area. The ions can adiabatically expand to form a supersonic free jet, and at least a portion of the ion transfer component can be disposed outside an area of free expansion.

The source of ions can comprise an orifice or aperture through which the ions emerge, and at least a portion of the ion transfer component can be disposed such that the orifice is disposed opposingly to the emerging ions. The ions generated by the source can emerge along an axis, and at least a portion of the ion transfer component can be disposed at an angle from the axis.

The invention can be implemented to realize one or more of the following advantages, alone or in various possible combinations. The ion transfer component can be manufactured to have sharp edges. The ion transfer component of the invention can be chemically inert. The ion transfer component can be durable and less prone to accidental breakage or deformation, maintaining its sharp edge and performance. The ion transfer component can be resistant to scratching. The ion transfer component can remove less heat from an ion-containing gas than components made of standard materials such as stainless steel. The ion transfer component can experience smaller changes in dimensions caused by thermal expansion. Use of ion transfer components of the invention can improve the transmission and the signal to noise ratio of the signal produced by the mass spectrometer.

The details of one or more embodiments of the invention are set forth in the accompanying drawings and the description below. The figures are not to scale, and in particular, certain dimensions may be exaggerated for clarity of presentation. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Before describing the invention in detail, it must be noted that unless otherwise defined, all technical and scientific terms used herein have the meaning commonly understood by one of ordinary skill in the art to which this invention belongs. In case of conflict, the present specification, including definitions, will control. All publications, patent applications, patents, and other references mentioned herein are incorporated by reference in their entirety. Unless otherwise noted, the terms "include", "includes" and "including", and "comprise", "comprises" and "comprising" are used in an open-ended sense—that is, to indicate that the "included" or "comprised" subject matter is or can be a part or component of a larger aggregate or group, without excluding the presence of other parts or components of the aggregate or group.

The invention provides systems and apparatus for mass spectrometry utilizing an ion transfer component.

As stated earlier, ion transfer components such as skimmers and lenses are used in mass spectrometry to efficiently transfer ions from one region to another, typically across or through a pressure differential, for example from the intermediate pressure chamber to the low-pressure chamber. These ion transfer components are typically utilized in situations where the effects of a high pressure region dominates the efficiency of ion transfer. Typically, these ion transfer components also assist in the guiding of sample ions from a region of adiabatic expansion through a small orifice and into a lower pressure chamber.

Skimmers, lenses, and other such ion transfer components are traditionally made of stainless steel for example, which is readily machined and relatively chemically inert. The invention described in this specification is directed to mass spectrometers that use an ion transfer component comprising titanium metal.

It has been found that the use of an ion transfer component made of titanium metal improves the quality of signals produced by a mass spectrometer. Without intending to be bound by theory, and as discussed in more detail below, the sensitivity of mass spectrometry measurements made with a mass spectrometer that uses an ion transfer component having a portion made of titanium metal, e.g. coated with titanium metal, or made in its entirety of titanium metal may be attributable to the thermal properties and machining attributes of titanium.

Figure 1A:
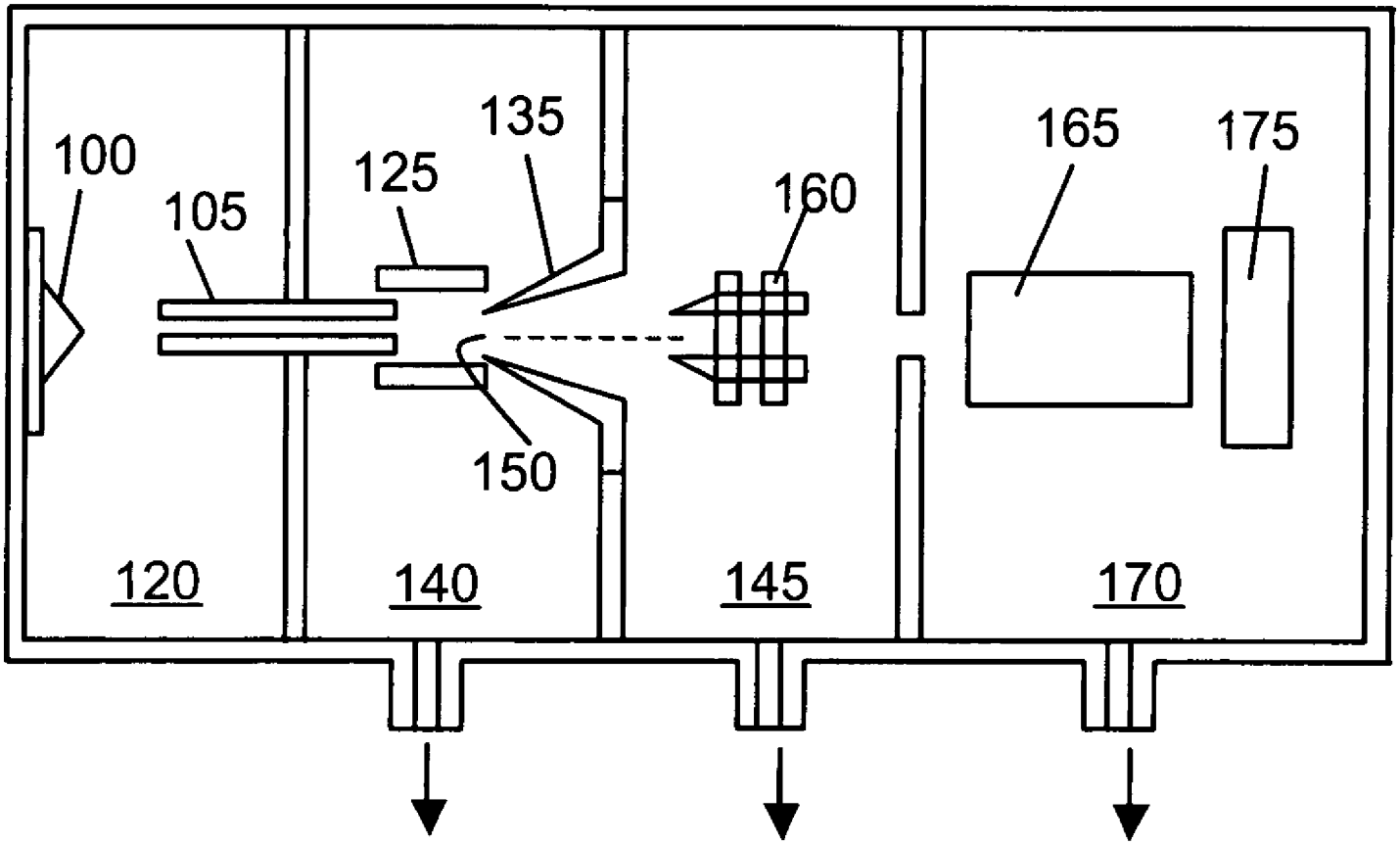
FIG. 1A is a schematic diagram of a mass spectrometer that employs atmospheric pressure ionization and an ion transfer component.

A schematic diagram of a mass spectrometer that uses atmospheric pressure ionization and an ion transfer component is shown in FIG. 1. The mass spectrometer includes an atmospheric ionization source 100, a mass analyzer 165, an ion detector 175, and a series of stages or chambers 120, 140, 145, and 170. In operation, ions derived from the ion source 100 are transmitted through the series of chambers 120, 140, 145, and 170 to the mass analyzer 165, where they are separated according to their mass-to-charge ratio. Ions of a desired mass-to-charge ratio (or range of mass-to-charge ratios) are then passed to the detector 175, where an ion signal is obtained and processed to provide a mass spectrum.

An ion transfer component 135 is placed at the boundary or interface between two chambers and defines a passageway for ions being transferred from one chamber to the other. The ion transfer component can be, for example, a lens with an orifice or a skimmer as shown in FIG. 1. Two or more ion transfer components can be used, as described in more detail in co-pending application Ser. No. 10/444,790, which is hereby incorporated by reference in its entirety. The mass spectrometer can include guide elements 125, 160 that help guide the path of ions in the chambers.

Ions are produced by the atmospheric pressure ionization source 100, which is in a first chamber 120 and is connected to receive a sample from an associated apparatus such as a liquid chromatograph or syringe pump. The atmospheric pressure ionization source 100 can be an electrospray ionization source, an atmospheric pressure chemical ionization source, an atmospheric pressure matrix assisted laser desorption source, a photoionization source, or a source employing any other ionization technique that operates at pressures substantially above the operating pressure of the mass analyzer 165. The ionization source 100 forms ions representative of the sample.

The ions are entrained in a background gas and transported from the ion source in the first chamber 120 through a capillary 105, which is typically heated and maintained at some electrostatic potential. The second chamber 140 is maintained at a lower pressure $P_2$ (e.g., 0.1–10 torr) than the atmospheric pressure $P_1$ (e.g., about 760 torr) of the first chamber 120, and the two chambers are connected by the capillary 105. The differences in pressure between chamber 120 and 140 cause the ion laden gas to flow through the capillary 105 towards the region of lower pressure $P_2$ in chamber 140. Upon exiting the capillary 105, the gas adiabatically expands to form a supersonic jet and the expansion is said to be free jet, shown in greater detail in FIG. 1B.

Figure 1B:
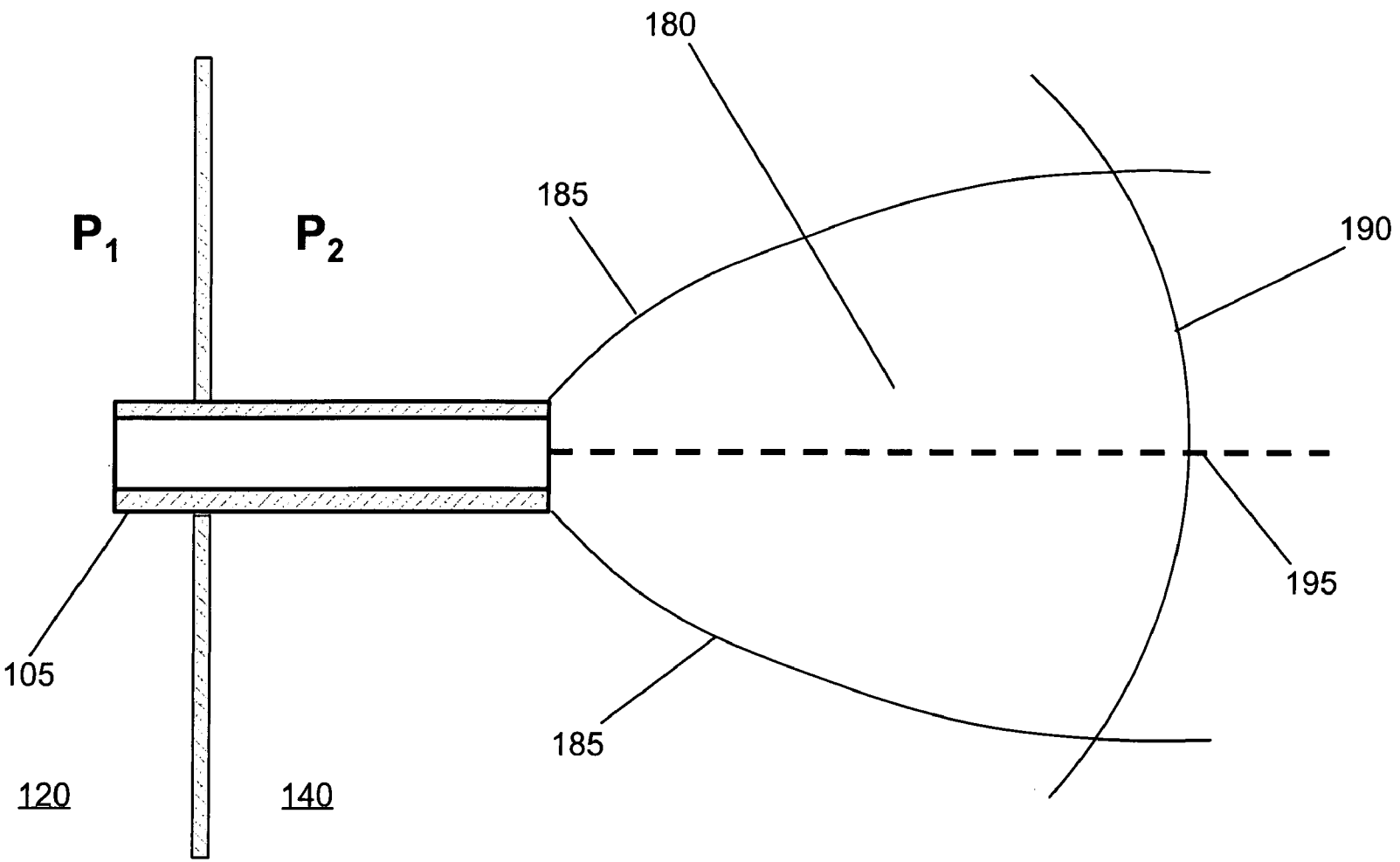
FIG. 1B is a schematic diagram illustrating the formation of a typical shock wave.

As shown in FIG. 1B, the capillary 105 traverses the two pressure chambers 120 and 140. The gas exiting capillary 105 expands isentropically, along the beam axis 195. The resulting supersonic expansion causes the molecules in the gas to move faster than the local speed of sound (M>1), and hence faster than information can propagate between the constituent molecules, creating a zone of silence 180. The ions in the zone of silence do not experience the downstream boundary conditions. As the expansion is forced to satisfy boundary conditions, thin nonisentropic regions of extreme pressure and temperature gradients are formed, defining the structure of a shock wave. These gradients are termed the barrel 185 (the parallel walls) and mach disc 190 shock waves.

The gas molecules and ions in the supersonic expansion undergo many collisions resulting in a hydrodynamic flow (cooling of the random molecular motion) and forcing the most effective trajectories along the beam axis 195. Since the ions have different masses and experience the same force of acceleration, there is a mass discrimination effect, with the lighter masses tending to have larger angles of deflection from the beam axis 195 and higher masses tending to congregate substantially along the beam axis 195.

Returning to FIG. 1A, the ion transfer component 135 is used to penetrate the shock wave structure and sample the ions in the zone of silence 180. In this manner, the end of the capillary 105 opposes the central aperture or orifice of the ion transfer component 135, which may be placed in the vicinity of the beam axis 195 to maintain the integrity of the beam. The shape of the ion transfer component 135 is critical to preventing the generation of additional shockwaves either prior to or within the component 135 itself.

The ion transfer component 135 separates the second chamber 140 from a third chamber 145, which is maintained at a lower pressure $P_3$ (e.g., $10^{-2}$–$10^{-4}$ torr) than the second chamber 140. The ion transfer component 135 can be electrically grounded or may have a voltage applied to aid in focusing ions. The ion transfer component 135 samples the ions and neutrals in the zone of silence 180 resulting from the free jet expansion. A portion of the background gases and a corresponding portion of the entrained ions are allowed to expand into the second chamber 140 and are pumped away. However, the gas dynamics are such that a portion of the gases and ions is skimmed from the free jet expansion leaving the capillary 105 and enters the lower pressure chamber 145 along the axis 150. Thus, the ion transfer component 135 acts to sample the ions in the zone of silence 180 and transfer them to a region of reduced pressure $P_3$.

Ions traveling through the ion transfer component 135 can be directed by additional guide elements 160 (e.g., a multipole ion guide) into a mass analyzer 165 in a high vacuum chamber 170, and, ultimately, to a detector 175 whose output can be displayed as a mass spectrum. Mass analyzer 165 can be any mass analyzer or hybrid of mass analyzers that can be configured to selectively transmit ions of a given mass or mass range. Mass analyzer 165 can include, for example, quadrupole mass analyzers, ion trap mass analyzer (3D or linear 2D ion traps), time of flight mass analyzers, fourier transform mass analyzers, sector mass analyzers, orbitrap mass analyzers, or the like.

Although the three pressure regions $P_1$, $P_2$, and $P_3$ are illustrated as being in three distinct chambers 120, 140, and 145, a pressure differential may occur in one single chamber and an ion transfer component can be within such a chamber and between two regions of differential pressure. For example, a series of skimmers may be utilized to increase the efficiency of transfer of ions to the mass spectrometer, as illustrated in U.S. Pat. No. 5,432,343, which is hereby incorporated by reference in its entirety.

In FIG. 1, the capillary 105 is illustrated as being directly opposing to the central aperture or orifice of the ion transfer component 135, and the front portion of the ion transfer component 135 penetrates the shock wave structure. It will be appreciated that the front portion of the ion transfer component 135 may be placed in the free jet expansion area, in the zone of silence 180 resulting from the free jet expansion area, outside the free jet expansion area, opposing (directly or otherwise), substantially parallel, or at an angle from the emerging ion laden gas. Typically, the aperture of the ion transfer component 135 is opposing to the capillary 105 but slightly offset on an axis orthogonal to the beam axis 195.

The ion transfer component 135 comprises in whole or in part titanium metal. For example, the ion transfer component 135 can be made of commercially pure titanium including commercial grade I, II, III, or IV titanium. Also for example, the ion transfer component can be made of an alloy of titanium, including for example an alloy of titanium and aluminum, vanadium, molybdenum, manganese, iron, platinum, tin, copper, niobium, zirconium, and/or chromium. The titanium alloy can be an alpha, alpha-beta, or beta type alloy. As used in this specification, the term titanium metal indicates that the titanium is present in a metallic form, rather than as part of a non-metallic compound such as titanium nitride, titanium oxide, or titanium sulfide.

Titanium is as strong as steel but 45% lighter, having a density of only 4.5 g/cm$^3$ at 293K compared to 8.0 g/cm$^3$ at 293K for stainless steel. Titanium also has a low heat capacity of $2.4\times10^6$ J/m$^3$K, which is about 60% that of stainless steel. Titanium has a low thermal conductivity, approximately equal to stainless steel and only 8% that of aluminum. The electrical conductivity of titanium is $23.8^{-1}$ mohm-cm. Titanium has a linear coefficient of thermal expansion approximately 50% that of stainless steel. Therefore, it will undergo smaller changes in dimensions with variations of temperature than stainless steel. Due at least in part to these physical properties, titanium is readily fabricated, durable, and capable of withstanding extremes of temperature.

Figure 2:
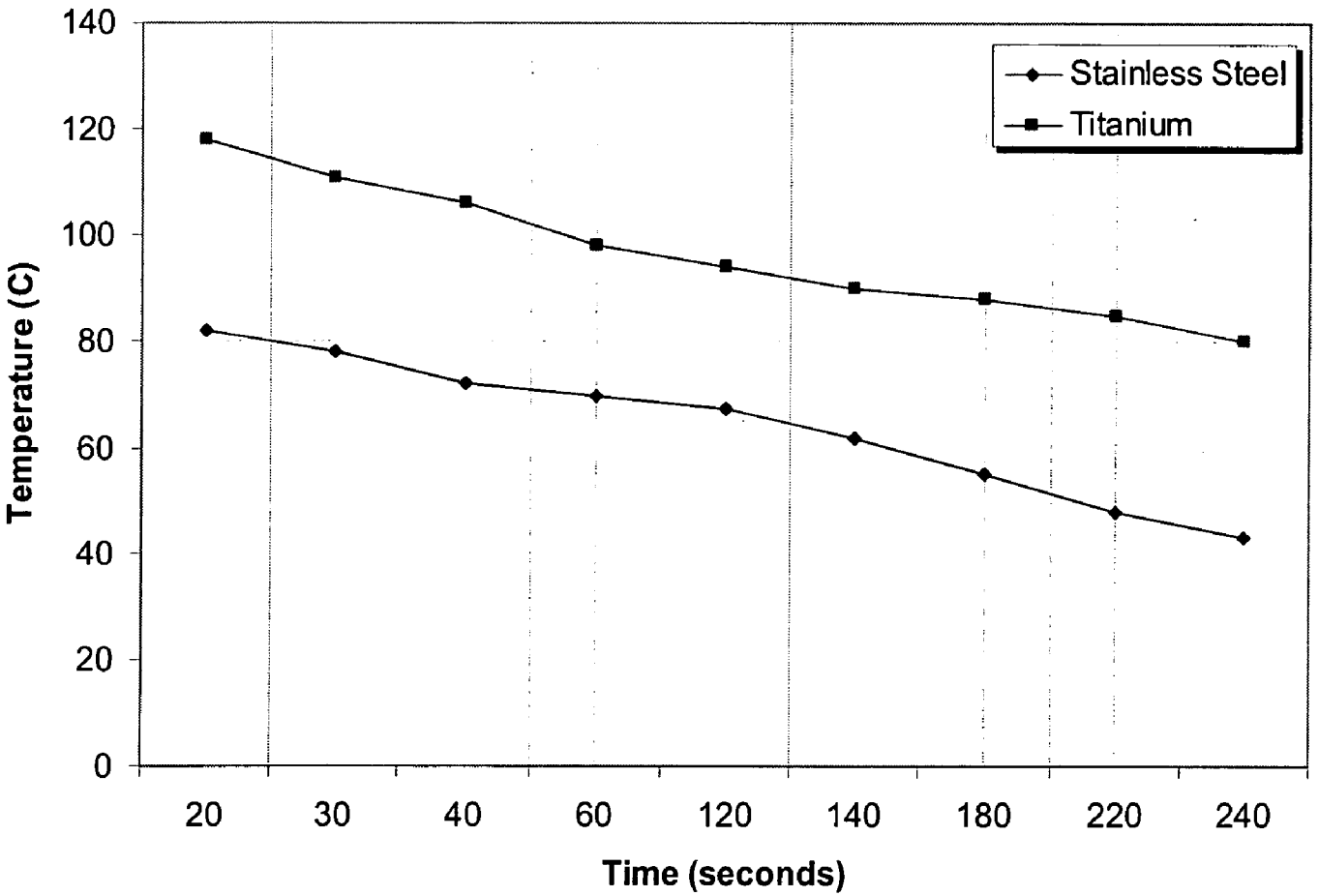
FIG. 2 shows the temperature profiles for a titanium skimmer and a stainless steel skimmer.

For example, as shown in FIG. 2, an ion transfer component 135 made of titanium rose to a higher temperature than an ion transfer component 135 made of stainless steel. These ion transfer components were skimmers. Each skimmer was heated externally for 30 seconds and then allowed to cool. The titanium skimmer achieved a temperature of 118° C., whereas the stainless steel skimmer achieved a temperature of only 82° C. The titanium skimmer also maintained a higher temperature than the initial and highest temperature of the stainless steel skimmer during almost two minutes of cooling.

Titanium can be machined to have a sharper and more effective edge than stainless steel, as discussed in more detail below. FIG. 3A illustrates an ion transfer component 135 made of stainless steel. As shown, the stainless steel ion transfer component includes exterior surfaces 304 that are exposed to one chamber 140 and interior surfaces 302 that define a cavity extending from the orifice 300 along the direction of flow towards another chamber 145. The region of the orifice 300 is shown in more detail in FIG. 4A. The lip or edge 405 of a new stainless steel ion transfer component is blunt, such that a diameter 402 of the orifice inside the cavity is approximately the same as the diameter 403 at the lip of the orifice.

Figure 3B:
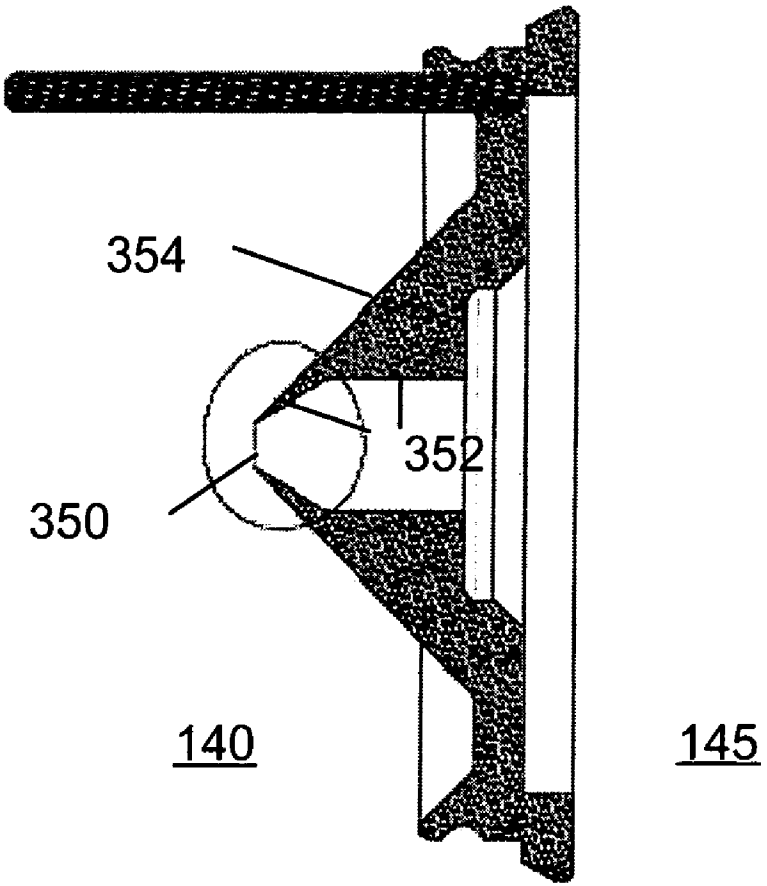
FIGS. 3A–B show an ion transfer component made of stainless steel and an ion transfer component made of titanium metal, respectively.
Figure 3A:
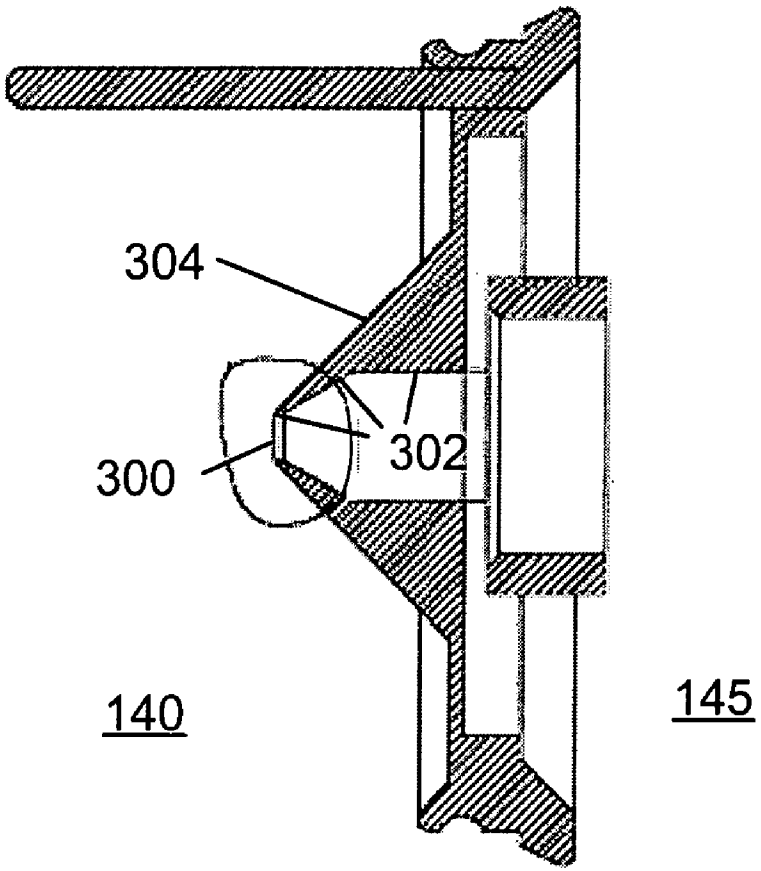

FIG. 3B illustrates an ion transfer component 135 made of titanium. As shown, the titanium ion transfer component includes exterior surfaces 354 that are exposed to a second chamber 140 and interior surfaces 352 that define a cavity extending from the orifice 350 along the direction of flow towards another chamber 145. The region of the orifice 350 is shown in more detail in FIG. 4B. When the ion transfer component is made of titanium, the lip or edge 455 is much sharper than when the ion transfer component is made of stainless steel, such that a diameter 452 of the orifice inside the cavity is greater than the diameter 453 at the lip of the orifice.

Figure 4B:
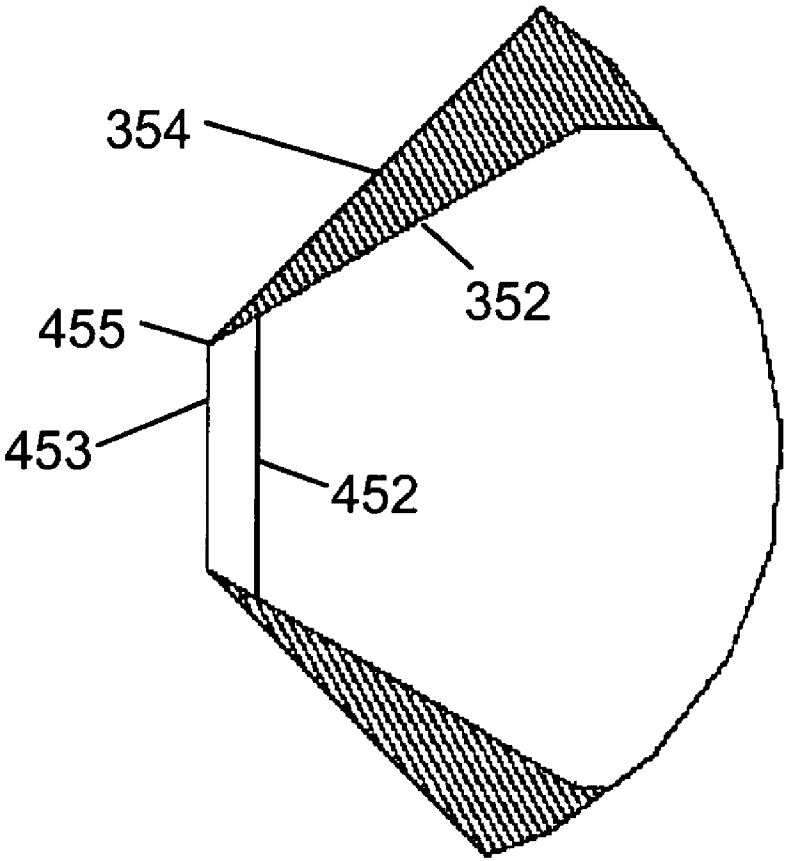
FIGS. 4A–B show in detail the edge of the orifice of an ion transfer component made of stainless steel and the edge of the orifice of an ion transfer component made of titanium metal, respectively.
Figure 4A:
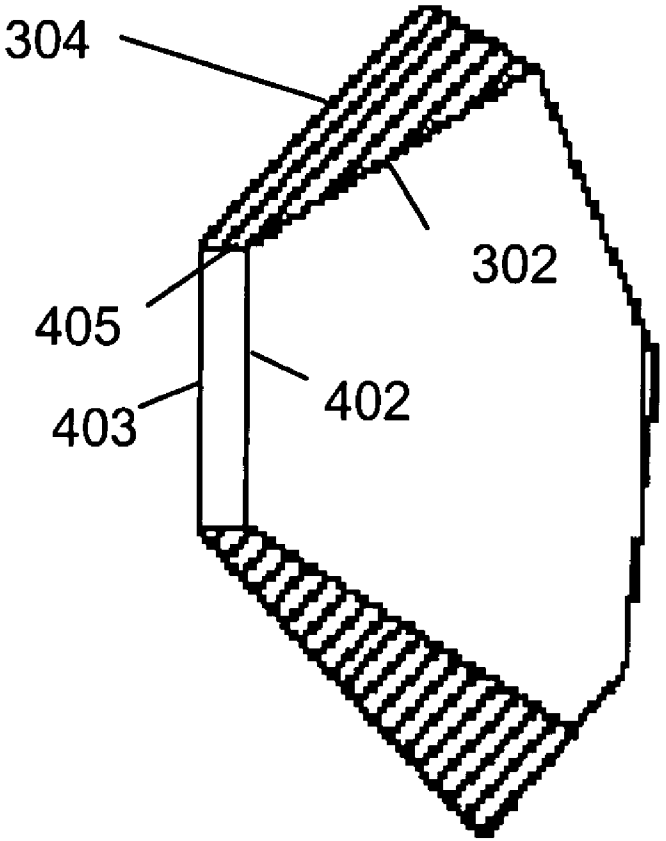

Ion transfer components that have sharp edges may perform better than ion transfer components that have blunt edges. A sharp skimming edge may be more efficient in penetrating and deflecting the shock wave structure away from the skimmer lip 455, limiting the effects of skimmer interference. Skimmer interference occurs when gas molecules deflect off the skimmer lip 455 into the interior of the skimmer, and can effectively reduce the skimmer diameter with respect to the sampled ion beam, causing a reduction in ion transmission. Sharp edges as shown in FIG. 4B may limit such effects and thereby improve the efficiency with which ions are sampled.

The sharper edge 455 on the titanium skimmer (FIG. 4B) compared to the edge 405 on the stainless steel skimmer (FIG. 4A) is made possible by the intrinsic properties of titanium, including its ability to withstand higher temperatures better than stainless steel and other metals used to fabricate ion transfer components such as skimmers. For example, the relatively low thermal conductivity of titanium allows sharp edges to be machined without the onset of thermally induced warping. Warping can occur in metals that have higher thermal conductivity than titanium, such as stainless steel, due to heat generated by the machine tool during machining. Thus, titanium can be machined to a sharper edge 455, as shown in FIG. 4B, in part because titanium is much less likely to warp under the required machining conditions than stainless steel.

Figure 5B:
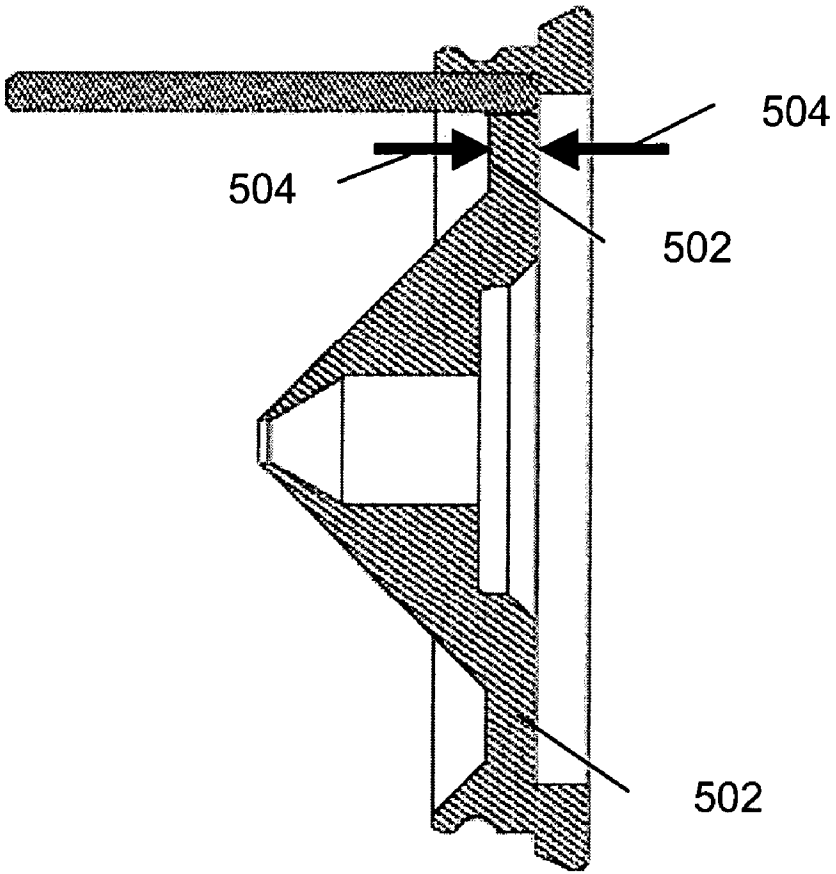
FIGS. 5A–B are schematic diagrams of two skimmers, illustrating a design that was readily fabricated using titanium metal but not stainless steel (5A) in comparison to a design that could be fabricated with either titanium metal or stainless steel (5B).
Figure 5A:
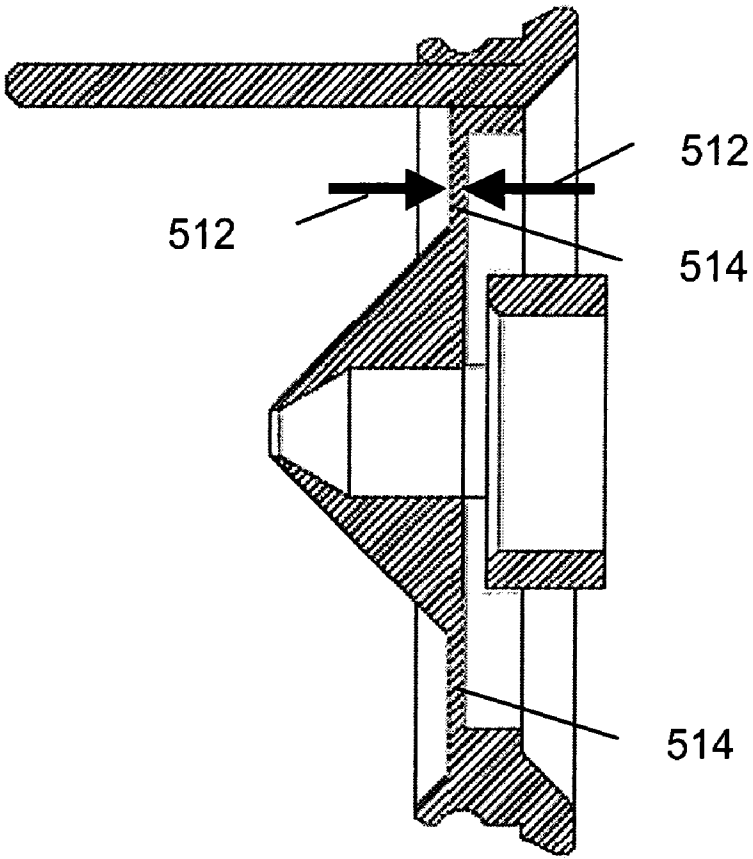

The intrinsic properties of titanium also allow thinner walls to be machined in the ion transfer component 135 than would be possible with the use of stainless steel. For example, as shown in FIG. 5B, traditional skimmers have relatively thick walls 502, as indicated by the distance between the arrows 504. An improved skimmer design shown in FIG. 5A and detailed in a co-pending application Ser. No. 10/444,790, hereby incorporated by reference in its entirety, required a significant decrease in wall thickness 512 as shown by the distance between the arrows 514. The geometry shown in FIG. 5A was readily fabricated using titanium but not stainless steel. Attempts to fabricate the geometry shown in FIG. 5A using stainless steel had high failure rates due primarily to thermal warping of the desired thin wall during machining.

Ion transfer components 135 comprising titanium metal can have any of many shapes and configurations, including the shapes and configurations of existing stainless steel ion transfer devices, variations on those shapes and configuration, and shapes and configurations that are difficult or impossible to make with stainless steel, for example, as described above.

In addition, ion transfer components 135 can be made in part of titanium metal. For example, an ion transfer component 135 made of stainless steel or aluminum can be coated with titanium metal such that one or more exposed surfaces of the ion transfer component 135, preferably including one or more surfaces contacted by ions, are titanium metal. Also for example, a part of the ion transfer component 135 can be made of titanium metal. For example, a part of the ion transfer component 135 surrounding and defining the orifice can comprise titanium metal while parts of the ion transfer component 135 that secure it to a chamber can be made of traditional materials such as stainless steel or aluminum.

Without intending to be bound by theory the thermal properties of titanium may limit the amount of heat that the titanium skimmer transfers as it bears the brunt of the impact of the adiabatic expansion. Since the gas that emerges from the heated capillary 105 is hot, and rapidly loses heat during the free jet expansion, any device in its path that actively transfers away heat is detrimental to the process of ion transmission. Whereas stainless steel may act as a continuous heat sink to the rapidly cooling hot gas emerging from the ion transfer tube 105, the titanium skimmer may be limited in its ability to transfer heat away from the gas, maintaining a higher temperature profile, as discussed above. Since the titanium skimmer achieves and maintains a higher local temperature compared to its stainless steel counterpart, the use of titanium reduces the temperature gradient in a region where the emerging gas is rapidly cooling.

Figure 6:
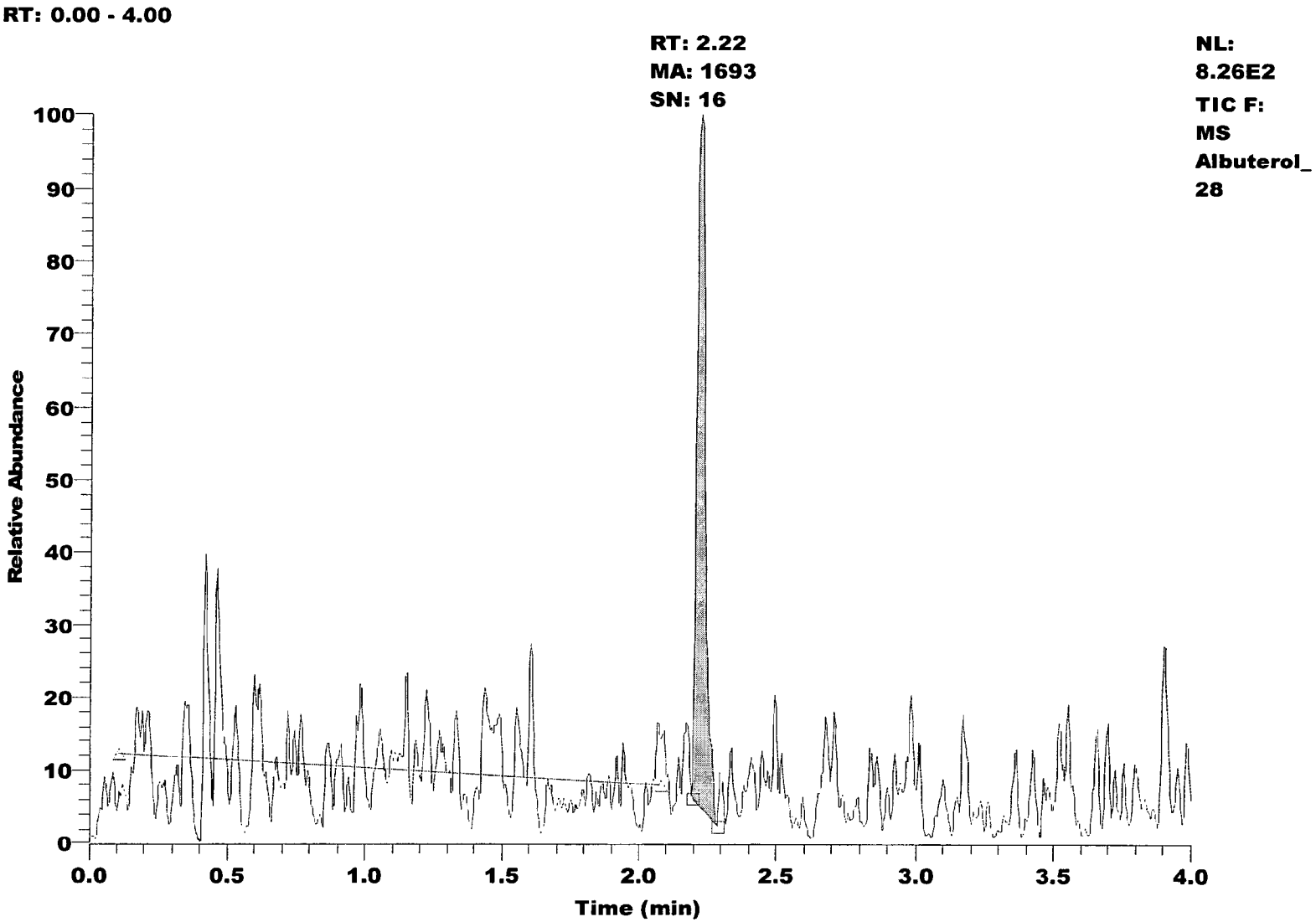
FIG. 6 is a mass spectrum for albuterol from a mass spectrometer with a stainless steel ion transfer component
Figure 7:
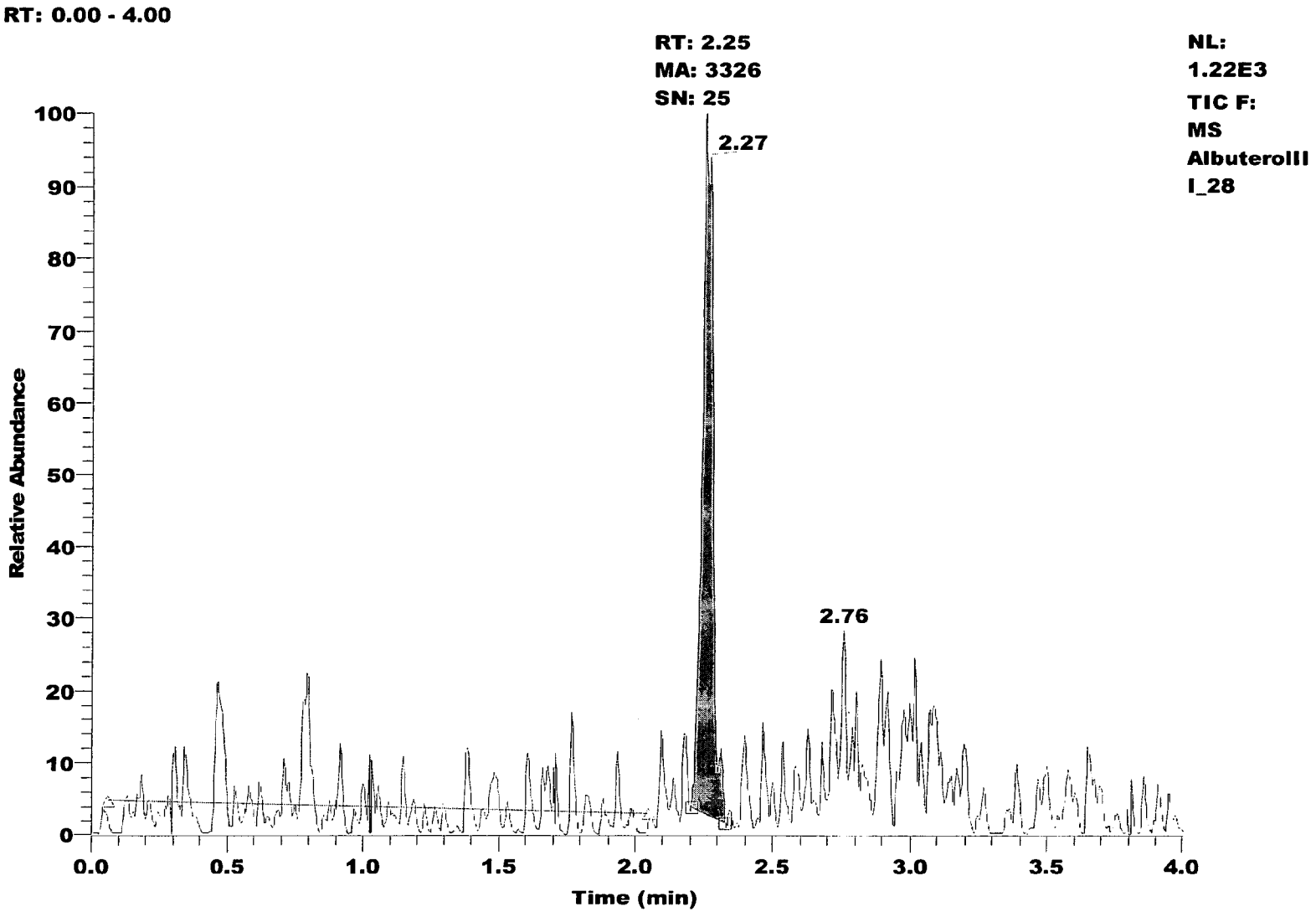
FIG. 7 is a mass spectrum for albuterol from the same mass spectrometer that was used to produce the results shown in FIG. 6, and operated under the same conditions, except that a titanium ion transfer component was used instead of a stainless steel ion transfer component.

As shown in FIGS. 6–7, the use of a mass spectrometer with a skimmer made wholly, i.e. in its entirety, of commercial grade II titanium results in clearly better analytical performance in terms of increased ion transmission compared to the use of a mass spectrometer with a skimmer made wholly out of stainless steel. FIG. 6 shows the SRM (m/z 240.2→m/z140) analysis of albuterol, a commercially available bronchodilator drug, with the use of a stainless steel skimmer. FIG. 7 shows the same SRM transition (m/z 240.2→m/z140) for the same compound with the same mass spectrometer under the same conditions except that the stainless steel skimmer was replaced by one made out of titanium.

As seen from FIG. 7, the use of a titanium skimmer resulted in an increase in overall sensitivity and enhanced signal-to-noise (S/N). The integrated peak area (MA 3326 vs. MA 1693) and peak height (NL $1.22\times10^3$ vs. NL $8.26\times10^2$) for 100 fg of albuterol injected on column was greater with the titanium skimmer than with the stainless steel skimmer. The use of a titanium skimmer also resulted in a higher S/N (25 vs. 16). In addition, the use of a titanium skimmer resulted in a spectrum with lower variance about the mean background signal and smaller deviations from that mean background signal—that is, a spectrum with less background noise, thus demonstrating the improvement in performance of the mass spectrometer due to replacement of the stainless steel skimmer with a titanium skimmer.

Without intending to be bound by theory, additional and quantum level properties of titanium may account for its improved performance. For example, work function is a property that defines the energy required to remove an electron from the metal and free it from the influence of that metal, and is a property of the metal itself. The work function of titanium metal is 4.33V ($\Phi$m). This property of titanium metal can offer advantages over metals commonly used to fabricate ion transfer components because of the low electron yield from secondary ion bombardment. The uncontrolled generation and emission of secondary electrons can impinge on the detection circuitry, which in most cases is a conversion dynode-electron multiplier system, creating noise in the detected signal.

Ion guides that are made of titanium may be able to suppress secondaries, typically electrons. For example, a collision cell is a type of ion transfer component because ions can be transferred into it. It can include a plurality of rods made for example of stainless steel, and can be enclosed for example in an aluminum body. Application of this invention suggests making the entire rods and/or the entire enclosing body from titanium metal, or making a portion of either or both of the rods and the enclosing body from titanium metal, for example, by coating the stainless steel and/or aluminum surfaces with titanium metal.

A number of embodiments of the invention have been described. Nevertheless, it will be understood that various modifications may be made without departing from the spirit and scope of the invention. For example, the skimmer may be placed in the free jet expansion area, in the zone of silence resulting from the free jet expansion area, outside the free jet expansion area, opposing to (directly or otherwise), substantially parallel or at an angle from the emerging ion laden gas. Accordingly, other embodiments are within the scope of the following claims.

What is claimed is:

1. A skimmer in a mass spectrometer comprising:

a body having an orifice through which ions can pass, wherein the entire body is wholly fabricated from titanium metal.

2. The skimmer of claim 1, wherein:

the body at least partially surrounds and defines the orifice.

3. The skimmer of claim 1, wherein:

the titanium metal comprises an alloy of titanium.

4. The skimmer of claim 3, wherein:

the alloy of titanium is an alloy of titanium and one or more of the metals in the group consisting of aluminum, vanadium, molybdenum, manganese, iron, platinum, tin, copper, niobium, zirconium, and chromium.

5. The skimmer of claim 1, wherein:

the titanium metal comprises commercially pure titanium.

6. The skimmer of claim 5, wherein:

the titanium metal comprises commercial grade I, II, III, or IV titanium.

7. The skimmer of claim 1, wherein:

the skimmer is configured such that an electrostatic potential can be applied.

8. The ion transfer component of claim 1, wherein:

the skimmer is configured such that an RF potential can be applied.

9. A system for analyzing ions, the system comprising:

a source of ions for generating ions; and a skimmer including a body having an orifice through which ions can pass, wherein the body is wholly fabricated from titanium metal.

10. The system of claim 9, wherein:

the ions adiabatically expand to form a supersonic free jet, and at least a portion of the skimmer is disposed in an area of the free jet expansion.

11. The system of claim 9, wherein:

the ions adiabatically expand to form a supersonic free jet, and at least a portion of the skimmer is disposed in a zone of silence resulting from the free jet expansion area.

12. The system of claim 9, wherein:

the ions adiabatically expand to form a supersonic free jet, and at least a portion of the skimmer is disposed outside an area of free expansion.

13. The system of claim 9, wherein:

the source of ions comprises an orifice or aperture through which the ions emerge, and at least a portion of the skimmer is disposed such that the orifice is disposed opposingly to the emerging ions.

14. The system of claim 9, wherein:

the ions generated by the source emerge along an axis, and at least a portion of the skimmer is disposed at an angle from the axis.

* * * * *